US006087018A

United States Patent [19]

Uchiyama

[11] Patent Number: 6,087,018

[45] Date of Patent: Jul. 11, 2000

[54] METHOD FOR SURFACE TREATMENT, ORNAMENTS AND ELECTRONIC DEVICES

[75] Inventor: Akira Uchiyama, Suwa, Japan

[73] Assignee: Seiko Epson Corporation, Tokyo, Japan

[21] Appl. No.: 09/007,129

[22] Filed: Jan. 14, 1998

[30] Foreign Application Priority Data

Jan. 14, 1997 [JP] Japan ..... 9-005008
Oct. 9, 1997 [JP] Japan ..... 9-277839

[51] Int. Cl.[7] ..... B32B 9/00

[52] U.S. Cl. ..... 428/469; 428/472; 428/432; 428/433

[58] Field of Search ..... 428/469, 472, 428/432, 433

[56] References Cited

U.S. PATENT DOCUMENTS

| | | | |
|---|---|---|---|
| 4,692,385 | 9/1987 | Johnson | 428/469 |
| 4,906,524 | 3/1990 | Takao | 428/336 |
| 5,006,419 | 4/1991 | Grunke et al. . | |
| 5,079,089 | 1/1992 | Ito | 428/336 |
| 5,102,697 | 4/1992 | Grunke et al. . | |
| 5,298,332 | 3/1994 | Andrus | 428/469 |
| 5,445,892 | 8/1995 | Riedl | 428/469 |
| 5,811,194 | 9/1998 | Kurze | 428/469 |

*Primary Examiner*—Timothy M. Speer
*Attorney, Agent, or Firm*—Stroock & Stroock & Lavan LLP

[57] ABSTRACT

A method for treating surfaces of titanium or titanium alloys which includes the steps of applying a treatment for removing surface adhesion substances from the surface and then forming a transparent protective layer on the surface.

17 Claims, 3 Drawing Sheets

METHOD FOR SURFACE TREATMENT, ORNAMENTS AND ELECTRONIC DEVICES

BACKGROUND OF THE INVENTION

This invention relates generally to a method for surface treatment, and an ornament and electronic device, and in particular to applying a transparent protective layer on the surface of titanium or titanium alloys.

As described in Japanese Unexamined Utility Model Publication No. 56-74060, Japanese Unexamined Patent Publication No. 58-96869 and Japanese Unexamined Patent Publication No. 62-263977, methods for coating a metal surface, such as aluminum, with a rigid transparent coating film thereby adding corrosion resistant, abrasion resistant and impact resistant properties to the metal surface, are known in the art. The transparent coating film is generally composed of a variety of organic resins and inorganic substances.

In one surface coating technique, a transparent coating layer of rigid inorganic materials including aluminum oxide or aluminum silicon is conventionally coated on the surface of metal facing cases such as those used for watches and clocks.

In the case of wristwatches, machine works are generally applied to the surface of facing cases constructed from various kind of metals such as stainless steel, brass and other metals. Examples of such machine works are honing processing by blasting fine grains, nicking processing and mirror finishing by buff finishing or barrel finishing. When such machine works are used, surface adhesion substances such as oxide layers are very likely to form on the surface of the facing cases, thus greatly diminishing the quality of appearance of the wristwatch.

Recently, titanium has been identified as a light and highly corrosion resistant material having a preventive effect for metal allergy. Often, titanium is used in combination with other metals where titanium is the main component thus forming a titanium alloy. Examples of metals that may be combined with titanium are Al, V, Mo, W, Fe, Co, Cr, Cu, Ag, Pt, Pd and Zn. The content of these metals is not especially limited as long as the metals do not alter the intrinsic properties of titanium.

Because titanium and titanium alloys oxidize easily, components constructed from these materials often have a titanium oxide layer (color change layer) formed on their surface. Formation of this oxide layer becomes evident when the machine works are applied to the component. The presence of an oxide layer can blacken the surface, which deterioates the quality of appearance of the component and therefore should be avoided.

The facing case of a watch is produced by assembling facing members of watches such as a case body, rear cover, cover glass and the like. A bezel is provided around the periphery of the cover glass (water crystal) in some watches. At least one of the case body or bezel of the facing members of watches may be produced with titanium or titanium alloys.

The facing members of a wristwatch are often produced by press molding, casting, powder metallurgy, lost wax and metal injection molding (MIM) techniques using titanium or a titanium alloy as a starting material. An appropriate cutting process can be applied to the facing member produced by press molding, if required.

Although titanium has advantages, problems can also exist when titanium is used for the facing case of a wristwatch. Although honing processing (honing finish) is the most frequently used machine works for finishing the surface of a facing case constructed from titanium, the surface of the titanium layer is easily damaged and oxidized when bombarded with glass beads during honing processing. This can blacken the surface. Also, because honing processing causes the surface to become uneven, the surface can be easily contaminated with fingerprints that are difficult to wipe off. In addition, when titanium is used for wristwatches, the wristwatches are more easily scratched because titanium has a Vickers hardness of only 150, which is less than the Vickers hardness of 200 for stainless steel (SUS).

Accordingly, it is desirable to provide a method and product which overcome drawbacks of the prior art.

SUMMARY OF THE INVENTION

Generally speaking, in accordance with the invention, a method for treating surfaces of titanium or titanium alloys which overcome drawbacks in the prior art is provided. The method includes the steps of applying a treatment for removing surface adhesion substances from the surface and then forming a transparent protective layer over the surface. The method of this invention can also be applied to titanium or titanium alloy surfaces that have been subjected to machine works, such as honing processing, nicking processing or mirror finishing. By applying the method of this invention to a surface constructed from titanium or a titanium alloy, the surface acquires an improved appearance having a whitish and glossy finish. Also, the surface becomes more durable thus preventing scratches, abrasions and corrosion from diminishing the appearance of the surface.

Accordingly, it is an object of this invention to provide a method for improving the appearance of titanium or titanium alloy surfaces.

Another object of the invention is to provide a method for improving the appearance of titanium or titanium alloy surfaces to which machine works have been applied.

Further object of the invention is to provide a method for making titanium or titanium alloy surfaces more durable and scratch, fingerprint, corrosion and abrasion resistant.

Still other objects and advantages of the invention will in part be obvious and will in part be apparent from the specifications and drawings.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which.

DESCRIPTION OF THE PREFERRED EMBODIMENT

Figure 1:
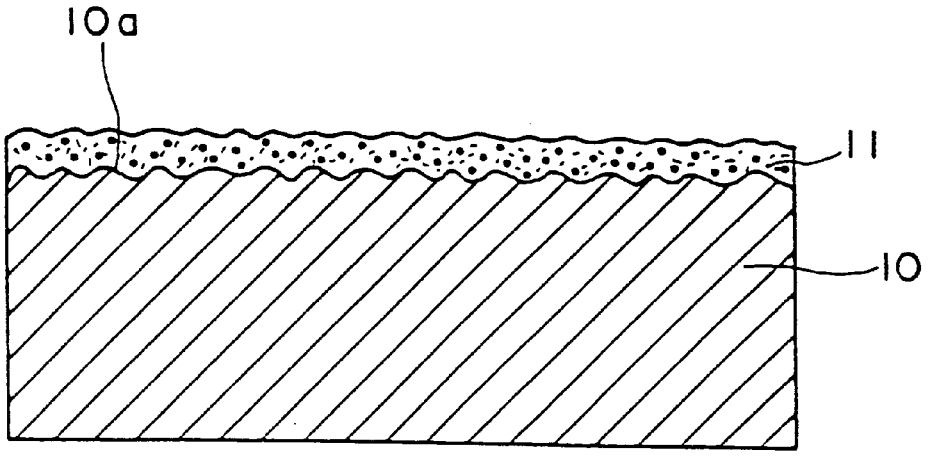
FIG. 1 is a cross sectional view of a facing member with an oxide layer formed on the surface.
Figure 2:
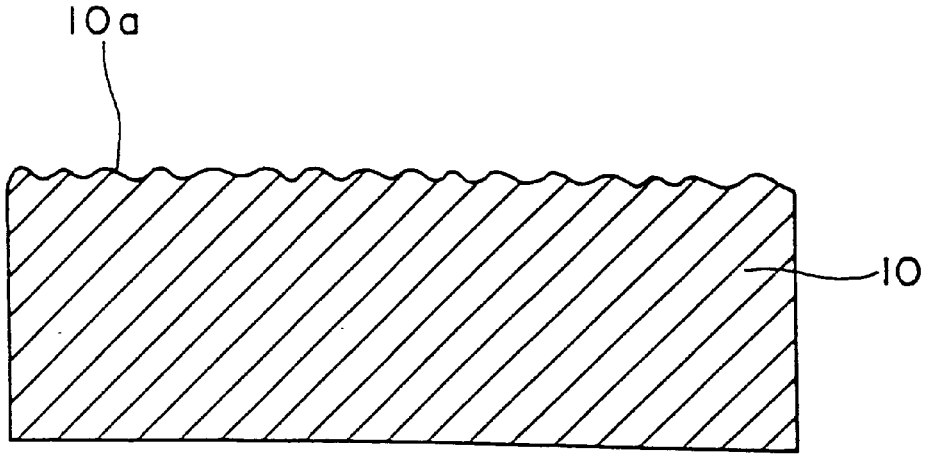
FIG. 2 is a cross sectional view of the facing member of FIG. 1 after the oxide layer has been removed.
Figure 3:
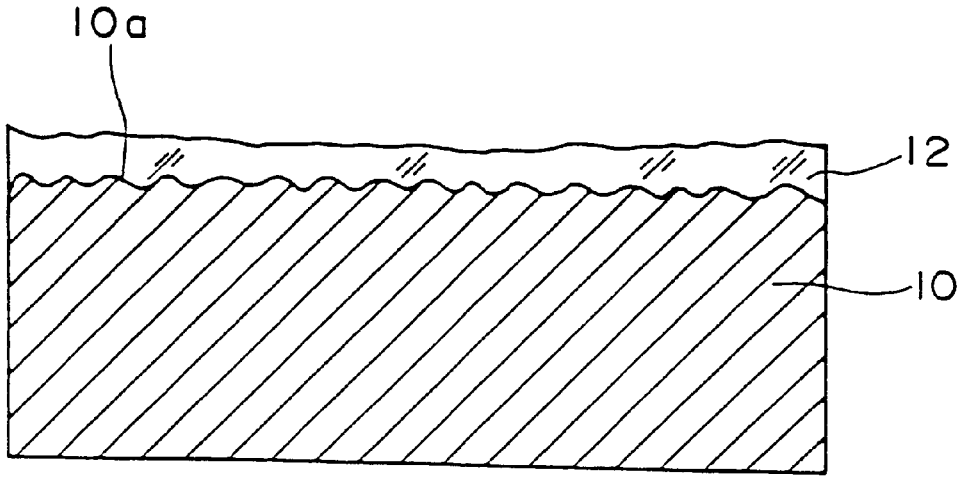
FIG. 3 is a cross sectional view of the facing member of FIG. 2 with a transparent protective layer formed on the surface.

Referring now to the FIGS. 1–3, there is shown a surface 10*a* of a facing member 10 of a watch after a machine work, such as honing processing, has been applied. An oxide layer (damaged oxide layer) 11, generated by the oxidation of titanium, is formed on surface 10*a* of facing member 10 constructed from titanium or a titanium alloy at the location where surface 10*a* suffers mechanical damage due to the application of machine works.

Because oxide layer 11 causes blackening of surface 10*a* of facing member, the appearance of the facing case of the watch is impaired, even if a transparent protective layer 12, such as a glass coating, is later applied to surface 10*a*. This can result in an undesirable "wet" look and detract from the watch's ornamental appearance. Thus, the presence of oxide layer 11 will damage the marketability of a watch as a high-class timepiece.

In accordance with the present invention, the appearance of the facing case of a watch constructed from titanium or titanium alloys is improved by removing oxide layer 11 from surface 10*a* by applying, for example, chemical polishing, the result of which is shown in FIG. 2. Chemical polishing can be performed by placing surface 10*a* in contact with an etching solution. After oxide layer 11 is removed from surface 10*a*, a transparent protective layer 12 is formed on surface 10*a* of facing member, as shown in FIG. 3.

Preferably, transparent protective layer 12 contains a glass component. Using such a glass coating layer will create a "wetting" effect caused by the refractive indices of the glass, which gives surface 10*a* a whitish, high-gloss appearance. This coating layer will also prevent traces of fingerprints on surface 10*a* from spoiling the appearance of facing member 10.

Transparent protective layer 12 can be of any thickness. However, a thickness in the range of 0.2 to 15 $\mu$m is preferred with a thickness in the range 0.8 to 5.0 $\mu$m more preferable. A thickness in the preferred range yields transparent protective layer 12 having a sufficient protective effect as well as having good film quality with few faults.

If transparent protective layer 12 is too thick, cracks caused by an impact force on facing member 10 may develop because the inner stress in transparent protective layer 12 is increased. If transparent protective layer 12 is too thin, its ability to prevent fingerprints from adhering to surface 10*a* and tiny scratches from appearing on surface 10*a* is diminished.

Transparent protective layer 12 can be of any hardness. However, a hardness in the range of 180 to 700, (expressed by a Vickers hardness defined in JIS Z 2244) is preferred, with a hardness in the range of 300 to 500 more preferable. This provides surface 10*a* with excellent abrasion and scratch resistance.

A method for surface treatment according to a preferred embodiment of the invention will now be described for purposes of illustration and is not intended to be construed as limiting.

1. Elimination of Surface Adhesion Substances

In this step, foreign materials such as oxide layer 11 and other contaminants (these are generally referred to as "surface adhesion substances") adhering to surface 10*a* of facing member 10 of a watch, especially on the portion of surface 10*a* subjected to machine works, are eliminated. By removing the surface adhesion substances from surface 10*a*, the inherent color of the substrate of facing member 10 is displayed even if surface 10*a* has previously exhibited a blackish color due to the oxidation of titanium. In this way, the quality of appearance of facing member 10 is improved because the degree of whiteness is enhanced and a high degree of glossiness is achieved.

Examples of treatments that can be used to remove the surface adhesion substances are (a) chemical polishing with an etching solution, (b) electropolishing, (c) washing with acids, alkali or water and (d) a combination of chemical polishing, electropolishing and washing. These treatments will now be described in more detail.

(a) Chemical Polishing with Etching Solution

Chemical polishing with an etching solution is an effective method for removing surface adhesion substances, especially a layer of titanium oxide. Chemical polishing is performed by placing facing member 10 in contact with an etching solution, for example, by immersing facing member 10 in the etching solution.

There are no specific requirements with respect to the composition and temperature of the etching solution, or the length of time facing member 10 should be immersed in the etching solution. However, it is preferable that the etching solution comprises a mixed solution containing hydrofluoric acid (HF), nitric acid ($HNO_3$) and sulfuric acid ($H_2SO_4$). A mixed solution of HF and $HNO_3$ may also be used, but the addition of $H_2SO_4$ results in surface 10*a* that is whitish without exhibiting any roughness.

It is also preferable that the etching solution be an aqueous solution containing 1% to 10% vol of HF, 15% to 40% vol of $HNO_3$ and 30% to 60% vol of $H_2SO_4$. By selecting such a composition range (the "optimum range"), the surface of facing member 10 can be polished to achieve a sufficient whiteness and glossiness within a comparatively short treatment time, and enable a high productivity polishing yield, without causing roughness to surface 10*a*.

When either one of HF and $HNO_4$ is not present or contained in small amounts in the etching solution, etching will either not proceed substantially or will proceed slowly. For example, if the content of HF is less than 1% vol or the content of $HNO_3$ is less than 15% vol, little etching effect will be obtained and the treatment time can be prolonged.

When the content of HF is greater than 10% vol or the content of $HNO_3$ is greater than 40% vol, surface roughness is likely to occur. Surface roughness is also likely to occur, resulting in a diminished etching effect, if the content of $H_2SO_4$ is less than 30% vol or if the content $H_2SO_4$ is greater than 60% vol.

Because surface roughness greatly affects facing member 10 to which a mirror finishing has been applied, it is more preferable to adjust the composition of the etching solution to 1% to 5% vol, 15% to 35% vol and 40% to 60% vol for HF, $HNO_3$ and $H_2SO_4$, respectively.

In an exemplary embodiment, the etching solution is prepared by mixing 5% vol of commercially available 45% to 50% vol hydrofluoric acid, 45% vol of commercially available 60% to 70% vol nitric acid and 50% vol of commercially available 98% vol concentrated sulfuric acid. The composition of the etching solution in this embodiment is 2.25% to 2.5% vol of HF, 27% to 31.5% vol of $HNO_3$ and 49% vol of $H_2SO_4$ with the balance water, thereby satisfying the optimum range. Chemical etching is then performed by immersing facing member 10 in the etching solution for about 30 seconds.

As shown in Examples 8 to 14 in Table 1 below, a good appearance can be obtained by appropriately adjusting the immersion time in the etching solution or adjusting other conditions, such as the temperature of the etching solution, even if the composition of the etching solution is out of the optimum range described above. Therefore, the composition of the etching solution used in accordance with this invention is not necessarily limited to the preferred optimum range.

The resulting quality of appearance of polished facing members 10 were evaluated by varying the composition of the etching solution and immersion times and subsequently washing facing members 10 with water. The results are listed in Table 1 below, together with the etching conditions. The substrate for the facing members used in this test was a sintered body formed by metal powder injection molding, the material being an alloy containing 6% wt of titanium and 1% wt of Al. Honing processing was applied on entire surface 10*a* of facing member 10. The etching temperature was 70° C. in all cases.

TABLE 1

| Example | Composition ratio (% by volume) | | | Immersion time | | |
|---|---|---|---|---|---|---|
| No | HF | $HNO_3$ | $H_2SO_4$ | 5 sec. | 30 sec. | 60 sec. |
| 1 | 5.0 | 30.0 | 50.0 | B | A | A |
| 2 | 1.0 | 35.0 | 50.0 | B | A | A |
| 3 | 10.0 | 35.0 | 50.0 | A | A | B |
| 4 | 5.0 | 15.0 | 50.0 | B | A | A |
| 5 | 5.0 | 40.0 | 45.0 | A | A | B |
| 6 | 5.0 | 30.0 | 30.0 | A | A | B |
| 7 | 5.0 | 30.0 | 60.0 | B | A | A |
| 8 | 0.5 | 35.0 | 50.0 | C | C | B |
| 9 | 11.0 | 35.0 | 50.0 | B | C | C |
| 10 | 5.0 | 13.0 | 45.0 | C | C | B |
| 11 | 5.0 | 42.0 | 45.0 | B | C | C |
| 12 | 5.0 | 35.0 | 28.0 | B | C | C |
| 13 | 5.0 | 25.0 | 63.0 | C | C | B |
| 14 | 2.5 | 35.0 | 0 | C | C | C |
| Comparative example 1 | No etching treatment | | | E | | |

The quality of appearance of facing member 10 after etching performed was classified into the following 5 ranks:

A: Very good appearance (a very high degree of whiteness)

B: Good appearance (a high degree of whiteness)

C: Normal appearance (a middle class of whiteness, slight roughness on the surface)

D: Rather bad appearance (blackish, roughness on the surface)

E: Bad appearance (evidently blackish, evident roughness on the surface)

Examples having an appearance rank of A or B are acceptable for all applications including those that require an especially high-grade of quality, while the examples having an appearance rank of C can be used for all applications except for those that require an especially high-grade of quality.

In Examples 1 to 7, etching solutions within the optimum range were used, while in Examples 8 to 14, etching solutions out of the optimum range were used. The products treated under the conditions of Examples 1 to 7 attained a superior quality of appearance than those treated under the conditions of Examples 8 to 14.

An excellent appearance was obtained in Examples 1, 2, 4 and 7 when the immersion time in the etching solution was a relatively long time of 30 seconds or 60 seconds, whereas an excellent appearance was obtained in Examples 3, 5 and 6 when the immersion time in the etching solution was a relatively short time of 5 seconds or 30 seconds.

In Example 8, a good appearance was obtained when the immersion time in the etching solution was 60 seconds because the content of HF was relatively small. On the other hand, when the content of HF was relatively large, such as in Example 9, a good appearance was obtained when the immersion time in etching solution was only 5 seconds.

In Example 10, a good appearance was obtained when the immersion time in the etching solution was 60 seconds because the content of $HNO_3$ was relatively small. On the other hand, when the content of $HNO_3$ was relatively large, such as in Example 11, a good appearance was obtained when the immersion time in the etching solution was only 5 seconds.

In Example 12, a good appearance was obtained when the immersion time was only 5 seconds because the content of $H_2SO_4$ was relatively small. On the other hand, when the content of $H_2SO_4$ was relatively large, such as in Example 13, a good appearance was obtained when the immersion time was extended to 60 seconds.

In Example 14, the appearance was normal for an immersion time of up to 60 seconds because $H_2SO_4$ was not added. However, a longer immersion time resulted in a good appearance (not shown).

In contrast, in Comparative Example 1, where no chemical polishing by etching was applied, the quality of appearance was bad.

The quality of appearance was also tested by varying the treatment time (immersion time) of facing member 10 subjected to honing processing, using a constant solution temperature and using an etching solution having the same composition as in Example 3 of Table 1. The results are listed in Table 2 below.

TABLE 2

| Temp. of solution: 70° C. | | | | | | | |
|---|---|---|---|---|---|---|---|
| Treatment time (sec.) | | | | | | | |
| 5 | 10 | 20 | 30 | 40 | 50 | 60 | 70 |
| A | A | A | A | A | A | B | B |

The quality of appearance was also tested by varying the solution temperature in which facing member 10 subjected to honing processing was immersed, and maintaining constant treatment time (immersion time) using an etching solution having the same composition as in Example 3 of Table 1. The results are listed in Table 3 below.

The methods used for evaluating the quality of appearance in Table 2 and Table 3 were the same as those used in Table 1.

TABLE 3

| Treatment time: 30 sec. | | | | | | | |
|---|---|---|---|---|---|---|---|
| Temp. of solution (° C.) | | | | | | | |
| 25 | 30 | 40 | 50 | 60 | 70 | 75 | 80 |
| B | A | A | A | A | A | A | B |

As shown in Table 2, an excellent quality of appearance was obtained at an etching solution temperature of 70° C. and an immersion time of 5 to 50 seconds, with a gradual tendency to cause surface roughening when the treatment time was 70 seconds or longer. Accordingly, the preferable treatment time is 5 to 50 seconds. However, a treatment time of 5 to 30 seconds is more preferable because it yields better surface smoothness and improved productivity.

Although an excellent quality of appearance was obtained for a treatment time of 30 seconds at a temperature range of 30° C. to 75° C., as shown in Table 3, the whiteness slightly decreased when the solution temperature was lowered to 25° C. Also, the etching effect was so enhanced when the temperature was raised to 80° C. that there was a tendency to exhibit a slight surface roughness. Based on these observations, the preferable solution temperature range is 30° C. to 75° C. However, a more preferable solution temperature range is 30° C. to 60° C., because it yields a better surface appearance and improves safety by operating in a lower temperature range.

(b) Electropolishing

Figure 4:
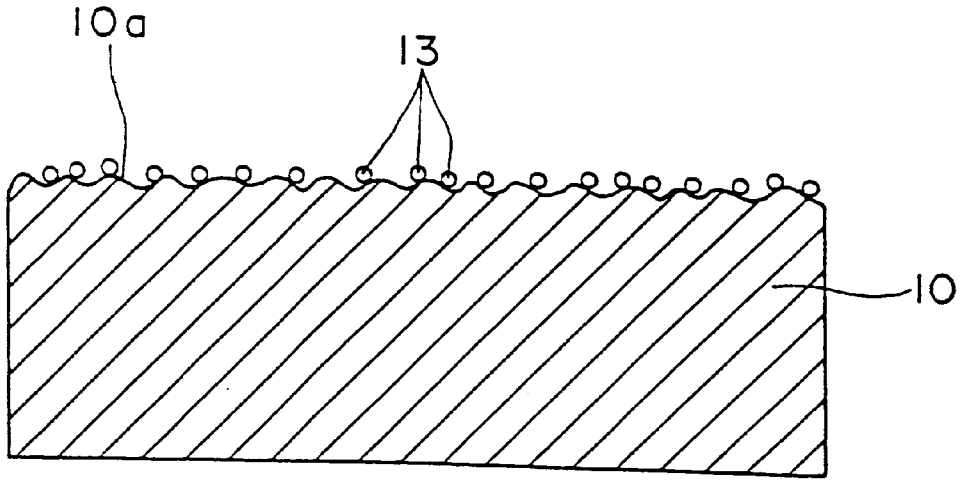
FIG. 4 is a cross sectional view of a facing member with foreign substances adhering to the surface.

Electropolishing can also be used to remove surface adhesion substances from surface 10*a* of facing member 10 of watches constructed from titanium or titanium alloys. Electropolishing is performed by dissolving (anode dissolution) facing member 10 in an electrolyte solution using facing member 10 as an anode. Electropolishing is described hereinafter referring to FIGS. 4–6.

A plurality of foreign substances 13, other than the substrate metals of facing member 10, adhere to surface 10*a* on which machine works were applied. Foreign substances 13 bombarded into surface 10*a* are especially present in the case when facing member 10 is subjected to honing processing.

If transparent protective layer 12, such as a coating glass layer, is formed on surface 10*a* without first removing from surface 10*a*, foreign substances 13, the adhesive property and durability of transparent protective layer 12 will be decreased.

Figure 5:
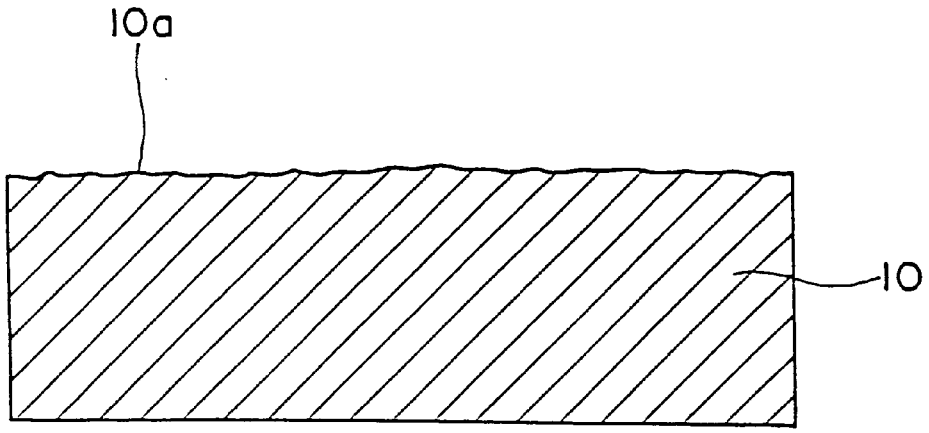
FIG. 5 is a cross sectional view of the facing member of FIG. 4 after the foreign substances have been removed.

To overcome this problem, in accordance with the present invention, transparent protective layer 12 is formed on surface 10*a* after foreign substances 13 have been removed by applying electropolishing, the results of which are shown in FIG. 5. If oxide layer 11 was formed on surface 10*a*, electropolishing can be used to remove oxide layer 11 together with foreign substances 13.

Figure 6:
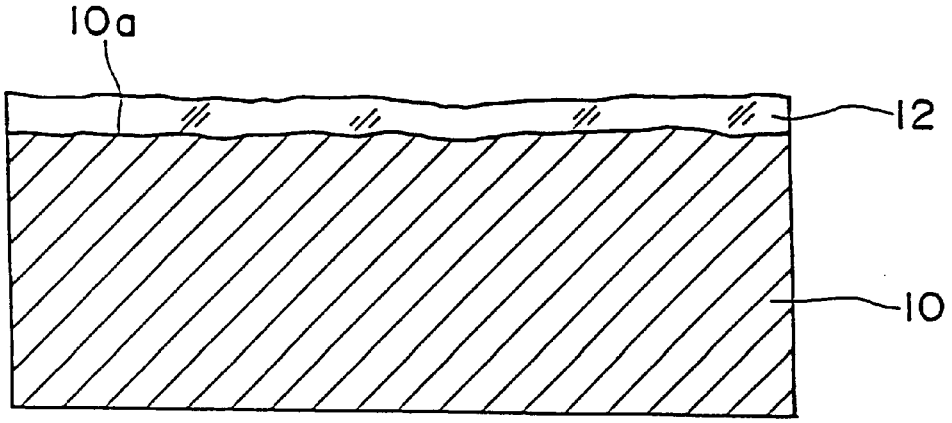
FIG. 6 is a cross sectional view of the facing member of FIG. 5 with a transparent protective layer formed on the surface.

According to the method described above, the film quality and adhesive property of transparent protective layer 12 is improved by removing foreign materials 13 from surface 10*a*, thereby making surface 10*a* uniform and substantially smooth. Thus, a transparent protective layer that is highly durable will be formed, possessing excellent fingerprint adhesion prevention and scratch resistant properties, as shown in FIG. 6.

Although the composition of the electrolyte solution, temperature, electric current density and treatment time are not limited to any particular values to provide the benefits under the present invention, preferable values for these conditions will be described below.

It is preferable that the composition of the electrolyte solution contain $H_3PO_4$ (phosphoric acid). Electrolyte solution containing $H_3PO_4$ is preferable for the electrolysis treatment of titanium or titanium alloys because it yields especially good surface properties.

The preferable concentration of the electrolyte solution is 8% to 12% vol. If the concentration of $H_3PO_4$ is too low, the polishing strength is lowered and foreign substances 13 are not fully eliminated within a short treatment time. If the concentration of $H_3PO_4$ is too high, polishing strength is so enhanced that the color of facing member of watches 10 may be easily changed.

Although the pH of the electrolyte solution is not limited to a particular value, the preferable pH range is usually 1.0 to 1.2, with a pH range of 1.05 to 1.1 being more preferable.

The temperature of the electrolyte solution is not limited to a particular value, but is preferably in the range of 25° C. to 30° C.

Electrolysis treatment time is not limited to a particular value, but is best determined based on the composition of the electrolyte solution and the electric current density used. To increase productivity, a treatment time of 3 seconds to 2 minutes is preferred, with a treatment time in the range of 5 seconds to 1 minute more preferred. If the electrolysis time is too short, electropolishing will be insufficient to yield the desired effect. On the other hand, even if electrolysis treatment time is made longer than the preferable treatment time, polishing will not be improved and a loss of productivity results.

The anode electric current density in electropolishing is not limited to a particular value, but a current density in the range of 0.5 to 10 amps per square centimeter (a/cm$^2$)is preferable and a current density in the range of 1 to 5 a/cm$^2$ is more preferable. By using a current density in the preferred range, electropolishing will be rapidly performed and produce surface 10*a* with high a degree of whiteness and quality.

If the anode current density is too low, sufficient electropolishing cannot be achieved in a short treatment time. If the anode the current density is too high, the color of surface 10*a* of facing member 10 is often changed, (e.g. turns yellow), reducing whiteness, especially if the treatment time is prolonged.

It should be noted that treatment conditions such as the composition of the electrolyte solution, the pH and the electric current density are not limited to the conditions described above.

The testing procedures used to evaluate electropolishing and the results obtained will now be described.

Facing members 10 used in this test were produced via press processing and cutting processing with a honing processing applied to entire surface 10*a*. The composition of the metal substrate of facing member 10 that was used was pure Ti.

After subjecting facing member 10 to an alkaline degreasing and acid neutralization treatment, in that order, electropolishing was applied to facing member 10 by varying the anode electric current density and the electrolysis treatment time and using two types of electrolyte solutions followed by washing with warm water (70° C.). The quality in appearance of facing member 10 was then evaluated. The composition of the electrolyte solution and the other electrolysis conditions are listed in Table 4 below and the results are shown in Table 5 below.

TABLE 4

| Table 4 Electrolysis condition | Type 1 | Type 2 |
|---|---|---|
| Composition of electrolyte solution | Phosphoric acid ($H_3PO_4$): 11 vol % water: balance | Phosphoric acid ($H_3PO_4$): 8 vol % water: balance |
| Specific gravity of electrolyte solution | 1.07 | 1.08 |
| Temperature of electrolyte solution | 30° C. | 25° C. |
| Heating method for electrolyte solution | Quartz-sheathed electric heater | Quartz-sheathed electric heater |
| Stirring of electrolyte solution | Yes | No |
| Cathode material | Stainless steel | stainless steel |

TABLE 5

| Example No | Electrolysis condition | Anode current density ($A/cm^2$) | Electrolysis time 5 sec | 15 sec | 30 sec | 60 sec | 120 sec | 130 sec |
|---|---|---|---|---|---|---|---|---|
| 15 | Type 1 | 0.5 | B | A | A | A | A | A |
| 16 | Type 1 | 1.0 | B | A | A | A | A | A |
| 17 | Type 1 | 2.0 | A | A | A | A | A | A |
| 18 | Type 1 | 3.5 | A | A | A | A | A | A |
| 19 | Type 1 | 5.0 | A | A | A | A | A | B |
| 20 | Type 1 | 7.0 | A | A | A | A | B | B |
| 21 | Type 1 | 10.0 | A | A | A | A | B | C |
| 22 | Type 2 | 1.5 | B | A | A | A | A | A |
| 23 | Type 2 | 2.5 | A | A | A | A | A | A |
| 24 | Type 2 | 4.0 | A | A | A | A | A | A |
| 25 | Type 2 | 5.0 | A | A | A | A | A | A |
| 26 | Type 2 | 7.0 | A | A | A | A | A | A |
| 27 | Type 2 | 10.0 | A | A | A | A | A | B |
| 28 | Type 2 | 12.0 | A | A | A | A | B | C |
| Comparative example 2 | No electropolishing | | E | | | | | |

The quality of appearance after electropolishing was classified into the following 5 ranks as shown in Table 5:

A: Very good appearance (a very high degree of whiteness)

B: Good appearance (a high degree of whiteness)

C: Normal appearance (a middle class of whiteness, slight color change to yellow)

D: Rather bad appearance (color change to yellow or a little foreign substances remain)

E: Bad appearance (color change to yellow evident, foreign substances remain)

Examples having an appearance rank of A or B are easily used for all applications including those that require an especially high-grade of quality, while the examples having an appearance rank C can be used for all applications except for those that require an especially high grade of quality.

In Examples 15 to 28, all products achieved at least a good quality in appearance. Of these Examples, the ones in which anodic electric current density and electrolysis treatment time were made optimum, yielded an excellent quality of appearance.

When electric current density was relatively low (Examples 15 and 22), a good quality of appearance was obtained by increasing the concentration of phosphoric acid or slightly lengthening treatment time.

When electric current density was relatively high, e.g. Examples 20, 21, 26, 27 and 28, a good quality of appearance was obtained by decreasing the concentration of phosphoric acid or slightly shortening the electrolysis treatment time.

In contrast, the quality of appearance was bad in Comparative Example 2 where electropolishing was not applied.

(c) Washing Treatments

Washing treatment methods include acid washing, alkaline washing (including alkaline degreasing and neutralization with an acid), water washing, warm water washing, washing with organic solvents such as alcohol and oil washing. One of these methods or an appropriate combination of two or more of these method can be used. The inclusion of a washing step makes it easier to remove surface adhesion substances, especially surface contaminants and foreign materials having a weak adhering strength.

An acid solution that can be used for the acid washing method is, for example, 3% to 5% of sulfuric acid while the alkaline solution that can be properly used for the alkaline washing method is, for example, 3.5% to 5% of Deepsol 41C (made by Deepsol Co.) a mild alkaline solution.

The washing procedure may be of any type including shower washing, jet washing, ultrasonic washing, precision washing or simply immersing in a washing solution or immersing in washing solution while stirring the solution.

The temperature of the washing solution is not limited to a particular value and any temperature in the range of room temperature to 100° C. can be used.

(d) Combination of Chemical Polishing, Electropolishing and Washing

The treatments described above in sections (a) to (c) can be used in any combination and in any order. For example, washing may applied after chemical polishing or electropolishing to improve the appearance of surface 10*a* and make it cleaner. By combining these different treatment methods, the appearance of surface 10*a* can be delicately adjusted, thereby improving the adhesive property of transparent protective layer 12, as described hereinafter.

2. Formation of Transparent Protective Layer

After removing surface adhesion substances, as described above, transparent protective layer 12 was formed on surface 10*a* of facing member 10, the results of which are shown in FIG. 3 and FIG. 6.

Transparent protective layer 12 can be constructed, for example, from a glass coating layer. One method of forming the layer in accordance with the invention will now be described.

A glass coating liquid can be applied to surface 10*a* of facing member of watches 10 by, for example, a coating method followed by drying, so that a transparent glass coating layer is formed on surface 10*a*. A suitable glass coating liquid may be obtained by dissolving and heating an alkali silicate as a main component, together with fine granular silica (An example is the transparent glass coating agent made by Okuno Seiyaku Kogyo Co., trade name CRM Coat 100).

The glass coating liquid (an original liquid) is produced by dissolving 100 parts by weight (as converted to solid fraction) of an alkali silicate such as sodium silicate or potassium silicate and 5 to 100 parts by weight of fine granular silica having a mean grain diameter of 40 $\mu$m and preferably heating the combination to a temperature in the range of 50° C. to 100° C., and more preferably, to a temperature in the range of at 80° C. to 100° C., for about 1 to 2 hours to allow the fine granular silica to dissolve (disperse) into the alkali silicate.

Water may be added at an upper limit of 600 parts by weight against 100 parts by weight of the total solid fraction described above, which makes dissolution easy and rapid.

While the inorganic transparent glass coating liquid can be used as an original liquid or by diluting it with a diluting solvent, it is preferable to dilute it with a diluting solvent. This not only enhances the workability of the coating process but also improves the film quality of transparent protective layer 12, especially its hardness and corrosion resistance.

The ratio of the glass coating liquid to the diluting solvent is preferably selected depending on the type of machine works applied to facing member 10, e.g. honing processing, nicking processing or mirror finishing. Making the appropriate selection will result in improved color tones of facing member 10, including the degree of whiteness and glossiness, while maintaining the corrosion resistant, abrasion resistant and scratch resistant properties of transparent protective layer 12 at a high level.

The preferable dilution ratio, based on the type of the machine works used, will now be described. The preferable range for the viscosity of the glass coating liquid which proportional to the dilution ratio will also be described.

Honing Processing

The preferable dilution ratio is 85% or less but a ratio of 30% to 70% is more preferable. For example, the dilution ratio can be adjusted to 70%, a water:original liquid (volume ratio) of 70:30, by adding water to the original liquid. The viscosity of the diluted solution is preferably in the range of 150 cps (25° C.) or more, with a viscosity in the range of 200 to 500 cps (25° C.) even more preferable.

Nicking Processing

The preferable dilution ratio and viscosity for nicking processing is substantially identical to that for honing processing.

Mirror Finishing

The preferable dilution ratio is in the range of 50% to 98% but a ratio of 90% to 98% is more preferable. For example, the dilution ratio can be adjusted to 95%, a water:original liquid (volume ratio) of 95:5, by adding water to the original liquid. The viscosity of the diluted solution is preferably in the range of 150 to 150 cps (25° C.), with a viscosity in the range of 150 to 250 (25° C.) being more preferable.

By using a dilution ratio that results in a viscosity in the preferred range, corrosion, abrasion and scratch resistance is improved. If, however, the dilution ratio is too high (the viscosity is too low), the corrosion, scratch and abrasion resistance properties of transparent protective layer 12 obtained from the glass coating liquid may be decreased. If the dilution ratio is too low (the viscosity is too high), the degree of whiteness or glossiness is decreased especially in members subjected to mirror finishing.

When transparent protective layer 12 is composed of a material other than glass, for example, an organic coating film, organic diluting solvents such as alcohols, benzene and toluene are used. These organic solvents can be used by mixing with water.

The glass coating liquid can be applied using a variety of coating methods including immersion (dipping), spraying, roll coating and coating with a brush.

The coating liquid applied to surface 10*a* is then dried. Drying conditions are not in any way limited, but it is preferable that drying be carried out at a temperature in the range of room temperature to 250° C. for 1 to 20 minutes, with the temperature range of 150° C. to 230° C. for 5 to 15 minutes being more preferable.

Drying may be performed two or more times under the same or different drying conditions. When drying is performed two or more times under different conditions (i.e. at least one parameter, e.g.; drying temperature or drying time (drying speed), is varied), the film qualities (especially denseness, homogeneity and uniformity of thickness) and adhesive property of transparent protective layer 12 is improved.

The coating and drying cycle may be repeated several times. For example, a glass coating liquid can be sprayed on the front portion of surface 10*a* of a wristwatch case using a spray gun followed by a temporary drying at 150° C. for 10 minutes. Then, the same glass coating liquid can be sprayed on the rear portion of surface 10*a* (inner surface) followed by a temporary drying at 150° C. for 10 minutes. Next, the coated case is subjected to a final drying at 180° C. for 10 minutes using a drying fan and ventilation fan resulting in transparent protective layer 12 made from a glass layer being formed. Transparent protective layer 12 using this procedure has sufficient hardness resulting in good corrosion resistant, abrasion resistant, scratch resistant, impact resistant, fingerprint adhesion preventive and adhesive properties.

To improve the corrosion resistance, abrasion resistance and scratch resistance properties provided by transparent protective layer 12, a plurality of glass coating liquid (coating liquid) application steps may be performed.

The testing procedures used to evaluate different coating liquids and the results obtained will now be described.

A concentrate of an original liquid used for a glass coating liquid was obtained by dissolving and heating 100 parts by weight (as converted to a solid fraction) of sodium silicate together with 50 parts by weight of fine granular silica having a mean grain diameter of 30 $\mu$m at 85° C. followed by stirring the solution for about 1 hour to dissolve (disperse) the fine granular silica into alkali silicate. The original liquid was then diluted with water in varying ratios to prepare glass coating solutions with a different dilution ratios and viscosities (25), as shown in Table 6 below.

Each glass coating solution was applied to surface 10*a* of different facing members 10 of watches after immersion in etching solution for 30 seconds. The different glass coatings were applied to surface 10*a* using the spray method. Then, a temporary drying step at 160° C. for 8 minutes and a final drying step at 185° C. for 10 minutes was applied resulting in the formation of transparent protective layers 12 having thicknesses (mean value) as shown in Table 6.

The resulting quality of appearance, Vickers hardness, fingerprint adhesion resistance, scratch resistance and adhesion property of transparent protective layer 12 was evaluated. The results are listed in.

TABLE 6

| Example No | Dilution ratio | Viscosity of coating solution (cps) | Thickness of transparent protective layer ($\mu$m) | Appearance H | Appearance S | Appearance M | Hv | Fingerprint adhesion resistance | Abrasion resistance Test 1 | Abrasion resistance Test 2 | Abrasion resistance Test 3 | Abrasion resistance Test 4 | Adhesive property of transparent protective layer |
|---|---|---|---|---|---|---|---|---|---|---|---|---|---|
| 29 | 10% | 500 | 10.0 | A | A | C | 600 | ◎ | ◎ | ◎ | ◎ | ◎ | ◎ |
| 30 | 30% | 450 | 5.0 | A | A | C | 500 | ◎ | ◎ | ◎ | ◎ | ◎ | ◎ |
| 31 | 50% | 400 | 4.0 | A | A | B | 350 | ◎ | ◎ | ◎ | ◎ | ◎ | ◎ |
| 32 | 70% | 300 | 2.0 | A | A | B~A | 250 | ◎ | ◎ | ◎ | ◎ | ◎ | ◎ |
| 33 | 80% | 250 | 0.8 | A | A | A | 180 | ◎ | ◎ | ◎ | ◎ | ○ | ◎ |
| 34 | 90% | 200 | 1.0 | A | A | A | 200 | ◎ | ○ | ○ | ○ | ○ | ◎ |
| 35 | 95% | 200 | 1.0 | A | A | A | 200 | ○ | ○ | ○ | ○ | ○ | ○~◎ |
| Comparative example 3 | Transparent protective layer is not formed. | | | — | — | — | — | x | Δ | Δ | Δ | x | — |
| Comparative example 4 | 80% | 250 | 2.0 | E | D~E | E | 250 | ◎ | ◎ | ◎ | ◎ | ○ | ○ |

The reference characters H, S and M in the Appearance column in Table 6 correspond to honing processing, nicking processing and mirror finishing, respectively.

The quality in appearance was visually evaluated and classified into the following five categories:

A: Very good appearance (a very high degree of whiteness and glossiness)

B: Good appearance (a high degree of whiteness and glossiness)

C: Normal appearance (a middle class of whiteness and glossiness)

D: Rather bad appearance (a little whiteness and glossiness)

E: Bad appearance (no whiteness and glossiness)

Examples having an appearance rank A or B are easily used for all applications including those that require an especially high-grade of quality, while the examples having an appearance rank of C can be used for all applications except for those that require an especially high grade of quality.

Fingerprint adhesion resistance was evaluated based on the degree of fingerprint adhesion caused by a light touch of fingers on surface 10*a* to which machine works H and M were applied, and the results were classified into the following 4 ranks:

⊙ no adhesion of fingerprint

○ insignificant adhesion of fingerprint

Δ some adhesion of fingerprint

X obvious adhesion of fingerprint

Scratch resistance was evaluated for surfaces 10*a* to which mechanical work H was applied. In Test 1, surface 10*a* was scratched $1.5\times10^4$ times with a sheet of cowhide under an applied pressure of 500 g/cm$^2$. In Test 2, scratching was performed with a piece of Aluminum (Al). In Test 3, scratching was performed with a piece of Brass (Bs). In Test 4, scratching was performed with stainless steel wire. The results were classified into the following 4 ranks:

⊙ no trace of scratching

○ insignificant trace of scratching

Δ some trace of scratching

X obvious trace of scratching

The adhesive property of transparent protective layer 12 to surface 10*a* to which machine work S and M were applied was evaluated based on the degree of peeling of transparent protective layer 12 that occurred when an adhering tape placed on surface 10*a* was peeled off. The adhesive property was classified into the following 4 ranks:

⊙ no peeling of the transparent protective layer

○ insignificant peeling of the transparent protective layer

Δ some peeling of the transparent protective layer

X obvious peeling of the transparent protective layer

As shown in Table 6, an excellent quality of appearance, fingerprint adhesion resistance, scratch resistance and adhesion property of transparent protective layer 12 was obtained in Examples 29 to 35. Also, whiteness, glossiness and the quality of appearance was improved when the dilution ratio was selected based on the type of machine works (H, S or M) applied.

In contrast, in Comparative Example 3 where no transparent protective layer 12 was formed, bad fingerprint adhesion resistance and scratch resistance properties resulted. In Comparative Example 4, where transparent protective layer 12 was formed without first applying electropolishing, bad quality of appearance and inferior adhesion properties of transparent protective layer 12 resulted.

The quality of appearance of transparent protective layer 12, Vickers hardness (Hv), fingerprint adhesion resistance, scratch resistance and adhesion properties of transparent protective layer 12 were evaluated with respect to the samples prepared by the same method as described above, except that surface 10*a* of facing member of watches 10 was prepared using the electrolysis treatment method with a treatment time of 30 seconds. The results are shown in Table 7 below.

TABLE 7

| Example No | Dilution ratio | Viscosity of coating solution (cps) | Thickness of transparent protective layer (μm) | Appearance H | Appearance S | Appearance M | Hv | Fingerprint adhesion resistance | Abrasion resistance Test 1 | Abrasion resistance Test 2 | Abrasion resistance Test 3 | Abrasion resistance Test 4 | Adhesive property of transparent protective layer |
|---|---|---|---|---|---|---|---|---|---|---|---|---|---|
| 36 | 10% | 500 | 10.0 | A | A | C | 600 | ⊙ | ⊙ | ⊙ | ⊙ | ⊙ | ⊙ |
| 37 | 30% | 450 | 5.0 | A | A | C | 500 | ⊙ | ⊙ | ⊙ | ⊙ | ⊙ | ⊙ |
| 38 | 50% | 400 | 4.0 | A | A | B | 350 | ⊙ | ⊙ | ⊙ | ⊙ | ⊙ | ⊙ |
| 39 | 70% | 300 | 2.0 | A | A | B~A | 250 | ⊙ | ⊙ | ⊙ | ⊙ | ⊙ | ⊙ |
| 40 | 80% | 250 | 0.8 | A | A | A | 180 | ⊙ | ⊙ | ⊙ | ⊙ | ○ | ⊙ |
| 41 | 90% | 200 | 1.0 | A | A | A | 200 | ⊙ | ○ | ○ | ○ | ○ | ⊙ |
| 42 | 95% | 200 | 1.0 | A | A | A | 200 | ○ | ○ | ○ | ○ | ○ | ○~⊙ |
| Comparative example 5 | Transparent protective layer is not formed. | | | — | — | — | — | x | Δ | Δ | Δ | x | — |
| Comparative example | 80% | 250 | 2.0 | D | D | E | 250 | ⊙ | ⊙ | ⊙ | ⊙ | ○ | x |

As shown in Table 7, an excellent quality of appearance, fingerprint adhesion resistance, scratch resistance and adhesion property of transparent protective layer 12 was obtained in Examples 36 to 42. Also, whiteness, glossiness and the quality of appearance was improved when the dilution ratio was selected based on the type of machine works (H, S or M) applied.

In contrast, in Comparative Example 5, where no transparent protective layer 12 was formed, bad fingerprint adhesion resistance and scratch resistance properties resulted. In Comparative Example 6, where a transparent protective layer was formed without first applying electropolishing, bad quality in appearance and inferior adhesion properties of transparent protective layer 12 resulted.

The coating liquid used to form transparent protective layer 12 is not limited to those previously described, and any parameter such as composition of the coating liquid, temperature, dilution ratio, viscosity or methods of coating may be modified. For example, various kinds of coating liquids containing inorganic substances such as aluminum oxide, silicon oxide or water glass can be used.

Transparent protective layer 12 is not limited to inorganic substances but may also be composed of a polymer material (an organic film) such as a rigid resin. Also, the method for forming transparent protective layer 12 is not limited to the coating methods described above but may also be formed using other methods of wet plating or dry plating, for example, evaporation, spattering, ion plating or CVD.

It is usually preferable to form transparent protective layer 12 within 144 hours after removing the surface adhesion substances for surface 10*a*. Otherwise, an oxidation film begins to form on surface 10*a* which may cause a slight color change to surface 10*a*.

Application of this invention is not limited to coating of approximately the entire surface of facing member of watches 10, the facing case or other ornaments, but transparent protective layer 12 may also be formed on part of surface 10*a*, or on a plurality of portions of surface 10*a*, of facing member 10 of watches, facing cases or other ornaments.

When a treatment for forming transparent protective layer 12 is applied by providing a masking on the inner face of facing case 10 of watches, transparent protective layer 12 is preferably not formed on the inner face of facing case 10 of watches. Otherwise, there is a possibility that the peelings from transparent protective layer 12, caused when the rear cover is snap-fixed to the case, will interfere with the watch movements, thus causing the retardation of or halt of the watch movements. This can be prevented by not forming transparent protective layer 12 on the engaging faces between the rear cover and case. Accordingly, the precise positioning of mechanical parts of the watch will not be adversely affected by transparent protective layer 12.

This invention is not limited to forming transparent protective layer 12 on a titanium or titanium alloy substrate, but is also applicable to the formation of transparent protective layer 12 on layers of titanium or titanium alloy that have been formed on a substrate of a different material.

Aside from facing cases of wristwatches, bands or completed watches, this invention is also applicable to other kinds of watches and clocks such as portable watches, table clocks or wall clocks.

Furthermore, the benefits of the present invention are suitable to applications other than clocks and watches, such as eye glass frames, tiepins, cuff links, lighters or their cases, pens, rings, necklaces, bracelets, brooches, pendants, earrings, piercing rings, coronets, ornaments, decorations, decorative goods such as interior products (being more or less decorative) and accessories. The invention can also be used for electronic devices such as electronic watches and clocks, portable phones, pocket bells, calculators, personal computers, word processors, printers, copy machines, cameras, video equipments, televisions, audio equipments, electronic toys and a variety of measuring apparatuses.

This invention is also suitable for various kind of components constructed from titanium or titanium alloys.

Thus, according to the foregoing descriptions, this invention provides several advantages over the prior art methods of surface treating of titanium or titanium alloys.

By using the present invention an excellent scratch resistant and fingerprint adhesion resistant transparent protective layer can be formed on the surface of titanium or titanium alloys.

By using a glass coating liquid, a transparent protective layer is easily formed that is highly rigid and that provides excellent corrosion and abrasion resistance.

By using chemical polishing or electropolishing with an etching solution on the surface of titanium or titanium alloys to remove surface adhesion substances, especially those that cause color change, prior to forming the transparent protective layer, the inherent colors of the titanium or titanium alloys are displayed with a high degree of whiteness and glossiness and with an improved quality of appearance. In this way, ornaments are given a high class appearance, increasing their commercial value.

Also, when chemical polishing with an etching solution is used, the appropriate selection of the composition of the etching solution or other treatment conditions makes it possible to produce a polished white surface without causing any roughening to the surface. A proper selection of the composition of the electrolyte solution, electric current density and other treatment conditions makes it possible to obtain a good surface that is smooth thus improving the degree of whiteness.

Finally, excellent surface quality can be obtained even when machine works such as honing processing, nicking processing or mirror finishing have been applied to the surface of titanium or titanium alloys.

In one aspect, this invention provides a method for surface treatment characterized by forming a transparent protective layer after applying a treatment for removing surface adhesion substances on the surface of titanium or titanium alloys.

In another aspect, this invention provides a method for surface treatment characterized by forming a transparent protective layer after applying a treatment for removing surface adhesion substances on the surface of titanium or titanium alloys subjected to machine works.

This invention enables the prevention of scratches and contaminations in addition to giving a good quality of appearance. The appearance becomes whitish and glossy because a transparent protective layer is formed after removing surface adhesion substances such as oxide layers, thereby an ornament with a high class appearance can be obtained. The transparent protective layer has a high adhesive property and good durability.

It is preferable that the machine work is any one of honing processing, nicking processing or mirror finishing.

Since surface adhesion substances such as an oxide layer are liable to occur when the machine works above are applied, improvements in the quality in appearance are further effected. This effect is also displayed when any one of the machine works above is applied.

The facing case of a watch is produced by assembling facing members of watches such as a case body, rear cover, cover glass and the like, a bezel being provided around the periphery of the cover glass in some watches. At least one of the case body and bezel of the facing members of watches may be produced with pure titanium or titanium alloys. This invention is applicable to a facing member of watches made of titanium or titanium alloys.

Titanium alloys contain titanium as a main component in which one or two or more kind of metals are incorporated. Examples of the metal to be incorporated into Ti are one or two or more kind of metals such as Al, V, Mo, W, Fe, Co, Cr, Cu, Ag, Pt, Pd and Zn, but are not limited thereto. The content of these metals is not especially limited so long as the metals do not alter the intrinsic properties of titanium.

The facing members of the wristwatch can be produced by a press molding, casting, powder metallurgy process, lost wax process and metal injection molding (MIM) using foregoing titanium or titanium alloy as a starting material. An appropriate cutting process is especially applied to the facing member produced by the press molding, if required.

A machine work is applied, if necessary, on the surface of the facing member of watches. Examples of such machine work are a honing processing by blasting fine grains, a nicking processing and a mirror finishing by buff finishing or barrel finishing.

Titanium is a metal so liable to be oxidized that an oxide layer (color change layer) mainly comprising titanium oxide is often formed by a surface oxidation. Formation of this oxide layer becomes evident when the machine works described above are applied. Formation of this oxide layer makes the surface blackish and deteriorates the quality in appearance, therefore it should be avoided as much as possible.

In a preferred embodiment of the invention, the transparent protective layer is a layer containing a glass component.

This construction of the invention enables the forming of a surface with a sufficient amount of hardness having an excellent scratching resistance, protecting contaminations like adhesion of with fingerprints and mechanical damages in a high level.

In a preferred embodiment of the invention, the transparent protective layer is formed by allowing a glass coating liquid to adhere on the surface subjected to the treatment for removing surface adhesion substances, followed by drying.

This construction of the invention enables the easy forming of a transparent protective layer with a high adhesive property of the layer.

In a preferred embodiment of the invention, the glass coating liquid is used after diluting its original liquid. It is especially preferable that the transparent protective layer is formed by allowing the glass coating liquid prepared by diluting its original liquid in a dilution ratio corresponding to the machine works to adhere, followed by drying.

This construction of the invention enables the improvement of the degree of whiteness and glossiness while maintaining a high degree of corrosion resistance, abrasion resistance and scratching resistance.

In a preferred embodiment of the invention, the viscosity of the glass coating liquid is 150 cps (25° C.) or more.

This construction of the invention further improves corrosion resistance, abrasion resistance and scratching resistance.

In a preferred embodiment of the invention, drying is carried out twice or more under different drying conditions.

This construction of the invention improves film quality and adhesive property of the transparent protective layer.

In a preferred embodiment of the invention, the treatment for removing surface adhesion substances is a chemical polishing with an etching solution.

This construction of the invention enables one to effectively remove the surface adhesion substances, especially a layer of titanium oxide.

In a preferred embodiment of the invention, the etching solution comprises a mixed solution containing HF, $HNO_3$ and $H_2SO_4$.

This construction of the invention enables one to make the surface white without roughening the surface of Ti or Ti alloys.

In a preferred embodiment of the invention, the etching solution is an aqueous solution containing 1 to 10 vol % of HF, 15 to 40 vol % of HNO3 and 30 to 60 vol % of $H_2SO_4$.

This construction of the invention makes it possible to constantly produce an ornament having a high quality in appearance with a high productivity.

In a preferred embodiment of the invention, the temperature of the etching solution is 30 to 75° C. and the treatment time with the etching solution is 5 to 50 seconds.

This construction of the invention also makes it possible to obtain a better quality in appearance besides improving the productivity.

In a preferred embodiment of the invention, the treatment for removing surface adhesion substances is an electropolishing.

This construction of the invention enables one to effectively remove the surface adhesion substances, especially foreign materials and a layer of titanium oxide.

In a preferred embodiment of the invention, the electrolyte solution used for electropolishing contains $H_3PO_4$.

This construction of the invention makes surface properties after the electrolysis treatment especially good.

In a preferred embodiment of the invention, the electropolishing is carried out at an anodic current density of 0.5 to 10 Amps/$cm^2$.

This construction of the invention makes it possible to allow electropolishing with a high whiteness and high quality in appearance to be rapidly carried out.

In a preferred embodiment of the invention, the time for the electrolysis treatment is 3 seconds to 2 minutes.

This construction of the invention makes it possible to sufficiently apply a required electropolishing without decreasing the productivity.

In a preferred embodiment of the invention, the treatment for removing surface adhesion substances is a treatment at least containing surface washing.

This construction of the invention enables one to easily remove surface adhesion substances, especially surface contaminants and foreign materials having a weak adhering strength.

In a preferred embodiment of the invention, the surface adhesion substances contain Ti oxide that causes blackening.

This construction of the invention enables one to enhance the degree of whiteness, improving the quality in appearance.

This invention provides an ornament characterized in that a transparent protective layer is formed on the surface of a metallic member comprising titanium or titanium alloys where adhesion substances have been removed.

This invention provides an ornament characterized in that a transparent protective layer is formed on the surface where machine works are applied on the metallic member comprising titanium or titanium alloys from which adhesion substances have been chemically removed.

The constructions of this invention enables one to prevent damages and contaminations, providing an ornament having a high quality in appearance. Because a transparent protective layer is applied after removing surface adhesion substances such as oxide layers, a whitish appearance can be obtained together with glossiness, giving a high class sense.

In a preferred embodiment of the invention, the machine work is any one of honing processing, nicking processing or mirror finishing.

When such machine works are applied, surface adhesion substances such as oxide layers are so liable to occur that the improvement of the quality in appearance becomes more eminent. When any one of the machine works above is applied, the effect described above can be also displayed.

In a preferred embodiment of the invention, the transparent protective layer is a layer containing glass components.

This construction of the invention enables one to form a surface provided with a sufficient amount of hardness, highly preventing contaminations such as adhesion of fingerprints and from being damaged.

In a preferred embodiment of the invention, the thickness of the transparent protective layer is 0.2 to 15 $\mu$m.

This construction of the invention enables one to obtain a sufficient amount of protective effect as well as endowing the transparent protective group with a good film quality with few faults.

In a preferred embodiment of the invention, the transparent protective layer has a Vickers hardness of 180 to 700.

This construction of the invention further improves the abrasion resistance and scratching resistance of the transparent protective layer.

In a preferred embodiment of the invention, the ornament is a facing member for watches and clocks.

Since an especially excellent quality in appearance is required in the facing member of watches and clocks, this invention by which the foregoing effects are obtained can be advantageously applied.

In a preferred embodiment of the invention, a case is constructed to contain an electronic device at least a portion of which is decorated with the ornament as described previously.

In a preferred embodiment of the invention, the electronic device is timepiece such as a watch or clock.

It will thus be seen that the objects set forth above, and those made apparent from the preceding description, are efficiently attained and, since certain changes may be made in the above construction without departing from the spirit and scope of the invention, it is intended that al matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. An ornament, comprising a transparent protective layer formed over at least a portion of a surface of a metallic member containing titanium which is substantially free of surface adhesion substances.

2. The ornament of claim 1, wherein said surface adhesion substances comprise oxides of the metallic member.

3. The ornament of claim 2, wherein said transparent protective layer has a thickness in the range of 0.2 to 15 microns.

4. The ornament of claim 2, wherein said transparent protective layer has a Vickers hardness in the range of 180 to 700.

5. The ornament of claim 2, wherein said ornament is a facing member for timepieces.

6. The ornament of claim 2, wherein said ornament decorates at least a portion of an electronic device.

7. The ornament of claim 6, wherein said electronic device is a timepiece.

8. An ornament comprising a transparent protective layer formed on a surface of a metallic member containing titanium which had been subjected to machine works and having substantially no surface adhesion substances thereon.

9. The ornament of claim 8, wherein said surface adhesion substances comprise oxides of the metallic member.

10. The ornament of claim 9, wherein said transparent layer contains glass.

11. The ornament of claim 9, wherein said transparent protector layer has a thickness in the range of 0.2 to 15 microns.

12. The ornament of claim 9, wherein said transparent protector layer has a Vickers hardness in the range of 180 to 700.

13. The ornament of claim 9, wherein said ornament is a facing member for a timepiece.

14. The ornament of claim 9, wherein said ornament decorates at least a portion of an electronic device.

15. The ornament of claim 14, wherein said electronic device is a timepiece.

16. The ornament of claim 1, wherein said transparent protective layer comprises glass.

17. The ornament of claim 8, wherein said machine works is selected from the group consisting of honing processing, nicking processing and mirror finishing.

* * * * *